US006547703B1

(12) United States Patent
Swezey et al.

(10) Patent No.: US 6,547,703 B1
(45) **Date of Patent: *Apr. 15, 2003**

(54) ISOMETRIC EXERCISE BALL

(76) Inventors: Robert L. Swezey, 10532 Garwood Pl., Los Angeles, CA (US) 90024; Richard Swezey, 148 N. Wilton Pl., Los Angeles, CA (US) 90004

( * ) Notice: Subject to any disclaimer, the term of this patent is extended or adjusted under 35 U.S.C. 154(b) by 0 days.

This patent is subject to a terminal disclaimer.

(21) Appl. No.: 09/676,961

(22) Filed: Oct. 2, 2000

Related U.S. Application Data

(63) Continuation of application No. PCT/US98/06714, filed on Apr. 2, 1998, which is a continuation of application No. 08/509,144, filed on Jul. 31, 1995, now Pat. No. 5,735,776.

(51) Int. Cl.[7] ..... A63B 21/002; A63B 21/008

(52) U.S. Cl. ..... 482/91; 482/112; 482/148; 601/23; 473/596

(58) Field of Search ..... 482/77, 89, 91, 482/111, 112, 122, 124–126, 121, 139, 148, 906, 907, 909; 472/134; 473/596, 603, 604, 606–610; 446/267, 220

(56) References Cited

U.S. PATENT DOCUMENTS

| | | | | | |
|---|---|---|---|---|---|
| 724,473 | A | * | 4/1903 | Hendrickson | 482/121 |
| 760,004 | A | * | 5/1904 | Lindsay | 482/89 |
| 777,478 | A | | 12/1904 | Minor | |
| 1,187,029 | A | * | 6/1916 | Beebout | 473/604 |
| 1,782,254 | A | * | 11/1930 | Breidenbach | 273/453 |
| 2,115,926 | A | | 5/1938 | Hatton | 273/58 |
| 2,210,024 | A | * | 8/1940 | Cayo | 473/576 |

FOREIGN PATENT DOCUMENTS

| | | |
|---|---|---|
| JP | 62 72379 | 4/1987 |
| NL | 9500179 | 9/1996 |

OTHER PUBLICATIONS

CYBEX, Medical Strength Systems brochure, Technical Highlights, Nov. 1993.*

*Flaghouse Rehab Spring 1995 Catalog*, "Inflatable Multi-colored Grip Ball", p. 5 (1995).

(List continued on next page.)

*Primary Examiner*—Jerome W. Donnelly
*Assistant Examiner*—Victor Hwang
(74) *Attorney, Agent, or Firm*—Ladas & Parry

(57) ABSTRACT

A versatile bidirectional isometric exercise device is provided in the form of an inflatable flexible exercise ball (10A–C), about 46 cm (18 inches) in diameter, fitted with a pair of looped handles (12A–B, 30A, 30C), secured to diametrically opposite points of the ball, through which arms or legs can be placed for performing specialized exercises that use the ball (10A–C) in a tension mode. The ball (10A–C) is only partially inflated so as to provide soft compliant accommodation to various body surfaces, and can be utilized bidirectionally, i.e. either in compression or in tension, in conjunction with various body parts such as hands, legs, knees, feet, etc., for a broad array of isometric muscle exercises directed to overall body strengthening, particularly for persons prone to and/or desiring protection from the effects of osteoporosis. A sequence of recommended exercises may be depicted directly on the surface of the ball (10A–C). Attachment of the handles (12A–B) to the main ball portion may be made by sonic welding. In one embodiment an internal bladder (26) is enclosed in a fabric cover, and in one version of this, two hemispheric portions (28A–B) are formed to each provide an integral looped handle (30A, 30C). A pressure gauge and/or user-adjustable alarm indicator may be provided to indicate muscular force applied in either compression or tension.

10 Claims, 2 Drawing Sheets

U.S. PATENT DOCUMENTS

| | | | | | |
|---|---|---|---|---|---|
| 2,718,644 | A | | 9/1955 | Barr | 9/21 |
| 3,069,162 | A | | 12/1962 | Samuel | 272/79 |
| 3,243,020 | A | | 3/1966 | Friedlander | 190/57 |
| 3,785,642 | A | | 1/1974 | Sterlicchi | 272/70 |
| 4,023,808 | A | | 5/1977 | Hebert | 272/137 |
| 4,077,625 | A | | 3/1978 | Clarke | 272/116 |
| 4,357,009 | A | | 11/1982 | Baker | 272/96 |
| 4,376,533 | A | | 3/1983 | Kolbel | 272/137 |
| 4,405,129 | A | | 9/1983 | Stuckey | 272/130 |
| 4,406,453 | A | | 9/1983 | Herzfeld | 272/137 |
| 4,726,357 | A | | 2/1988 | DeStefano | 128/28 |
| 4,772,016 | A | | 9/1988 | Manion | 272/130 |
| 4,852,874 | A | | 8/1989 | Sleichter, III et al. | 272/137 |
| 5,005,826 | A | | 4/1991 | Merrick | 272/94 |
| 5,230,682 | A | * | 7/1993 | Myers | 482/122 |
| 5,236,411 | A | * | 8/1993 | Backman | 128/845 |
| 5,251,903 | A | | 10/1993 | Bixler et al. | 273/26 |
| 5,282,777 | A | | 2/1994 | Myers | 482/122 |
| 5,338,276 | A | | 8/1994 | Jull et al. | 482/113 |
| 5,522,757 | A | * | 6/1996 | Ostrowski | 446/220 |
| 5,735,776 | A | | 4/1998 | Swezey et al. | 482/91 |
| 5,810,700 | A | * | 9/1998 | Orcutt | 482/121 |
| 6,068,580 | A | * | 5/2000 | Myers et al. | 446/220 |

* cited by examiner

ISOMETRIC EXERCISE BALL

This application is a continuation International Application PCT/US98/06714 (filed on Apr. 2, 1998), which designated the U.S. and which is a continuation of U.S. Ser No. 08/509 144, filed Jul 31, 1995, now U.S. Pat. No. 5,735,776.

FIELD OF THE INVENTION

The present invention relates to the field of exercise devices and more particularly a ball-shaped exercise device for performing site-specific isometric exercises directed to overall body strengthening and protection against the effects of osteoporosis.

BACKGROUND OF THE INVENTION

The need for exercise has been increasingly recognized. In addition to the benefits of better overall health and fitness, the strengthening of muscles and bones reduce the risk of fractures of the spine and hips as a major consequence of osteoporosis. Strong muscles stimulate the formation of stronger bones, provide the muscle control that helps to keep one's balance and prevent falls, help maintain an upright posture and prevent the "dowager's hump" of osteoporosis, and provide shock-absorbing fracture protection to the skeleton when an unavoidable fall occurs.

The present invention addresses isometric exercise, wherein, with little or no movement, one set of muscles is tensed for a period of seconds in opposition to another set of muscles or to an immovable object. Such isometric exercises are thus distinguished from isokinetic exercises wherein a muscle force is applied to a constant velocity of motion, as for example in pulling the handles of a rowing machine, or isotonic exercise when a constant weight is lifted through a range of motion.

Many isometric exercises require or are enhanced by the use of an exercise device providing force(s) that counterbalance the muscular force(s) applied by the exercising person. Amongst a recommended set of isometric exercises, some will require muscles to contract concentrically under uniform fiber tension, while others will require excentric muscular expansion. Accordingly, in the field addressed by present invention, the exercise device must be bidirectional, as distinguished from unidirectional devices, e.g. those utilizing stretch cords or bands, or long thin coil springs that can operate only in tension and cannot operate in compression.

DISCUSSION OF RELATED KNOWN ART

Examples of unidirectional isometric exercise devices are found in U.S. Pat. No. 4,023,808 to Hebert for a RESILIENT FORCE RESISTOR TYPE EXERCISING DEVICE and U.S. Pat. No. 4,852,874 to Sleichtser III et al for a PORTABLE ISOKINETIC EXERCISING DEVICE: these utilize elastic stretch band loops as resistance elements.

Examples of bidirectional isometric exercise devices are found in U.S. Pat. No. 4,376,533 to Kolbel for a PUSH AND PULL TYPE EXERCISING DEVICE and U.S. Pat. No. 4,406,453 to Herzfeld for a PORTABLE EXERCISER: these utilize metal springs as resistance elements.

U.S. Pat. No. 2,115,926 by Hatton for HANDLE FOR INFLATED BALLS AND THE LIKE is of interest in showing an inflated ball with a pair of solid hand grips recessed at diametrically opposite locations of the ball; however the ball is for athletic game purposes only and is not intended or suitable for use as an isometric exercise device as addressed by the present invention.

In the above mentioned examples of known art exercise devices, the handles provided are intended for two-handed operation only, and do not accommodate feet or legs, furthermore they fail to provide a sort accommodating surface that can be applied against various body surfaces.

OBJECTS OF THE INVENTION

It is a primary object of the present invention to provide a versatile bidirectional isometric exercise device that can be utilized in conjunction with various body parts such as hands, legs, knees, feet, etc., for exercising muscles in both opposite directions, i.e. not restricted to isotonic exercises.

It is a further object to provide an exercise device directed to overall body and paraspinal strengthening particularly for persons prone to or desiring protection from the effects of osteoporosis.

It is a further object that the exercise device permit soft accommodation to various body surfaces for a broad array of isometric exercises.

It is a further object to realize an exercise device meeting the foregoing objects in a very simple structure that does not require metal springs, stretch cords or the like, or mechanisms such as lever arms.

It is a further object to realize an inflatable exercise device that can be deflated for easy carrying and convenient storage.

SUMMARY OF THE INVENTION

The abovementioned objects have been accomplished in the present invention of an inflatable isometric exercise ball, about 46 CM (18") in diameter, fitted with a pair of strap-like handles, that can also serve as stirrups, located at diametrically opposite regions of surface of the main ball portion. The ball is less than fully inflated so as to interface comfortably with various regions of the body. In a recommended sequence of isometric exercises directed to particular different body regions, some of the exercises utilize the ball in a tension mode with the user's arms or legs inserted through the handles, while other exercises utilize the ball in a compression mode, squeezed between body parts or between a body part and a wall or floor.

A recommended sequence of exercises may be depicted by graphic illustrations printed directly on the surface of the exercise ball.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
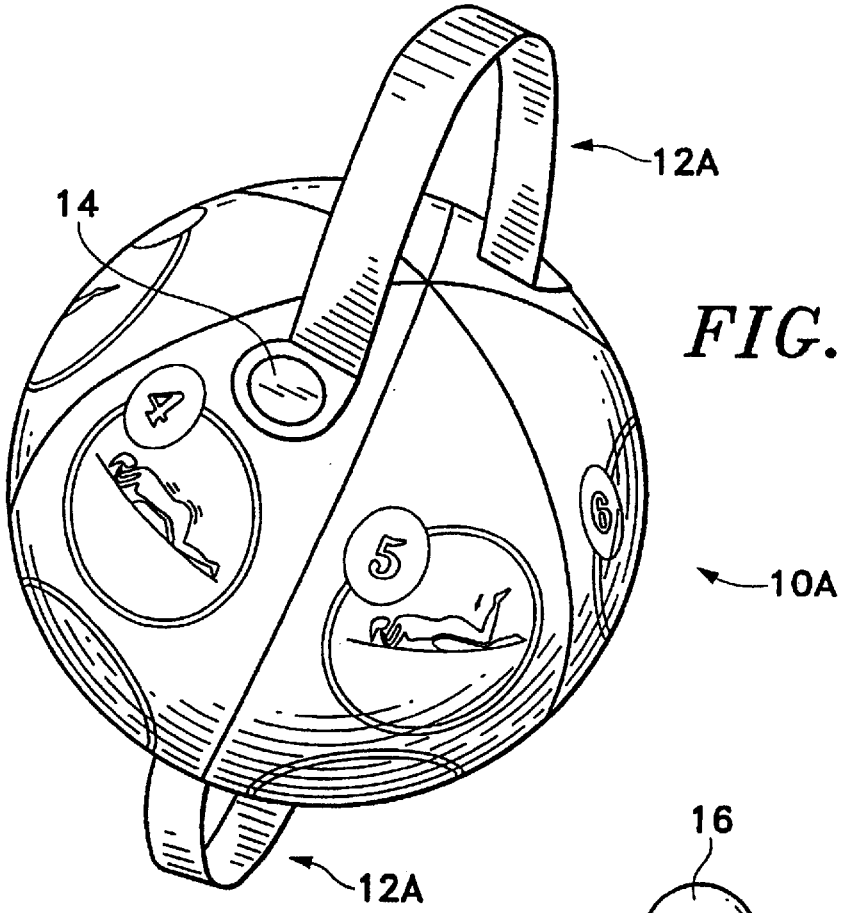
FIG. 1 is a perspective view of a first embodiment of an exercise ball of the present invention.

FIG. 1 is a perspective view of an exercise ball 10A, in a first embodiment of the present invention equipped with a pair of diametrically-opposed strap-like handles 12A attached to the main portion of ball 10A by a sonic weld 14 at each end of each handle 12A.

Figure 2:
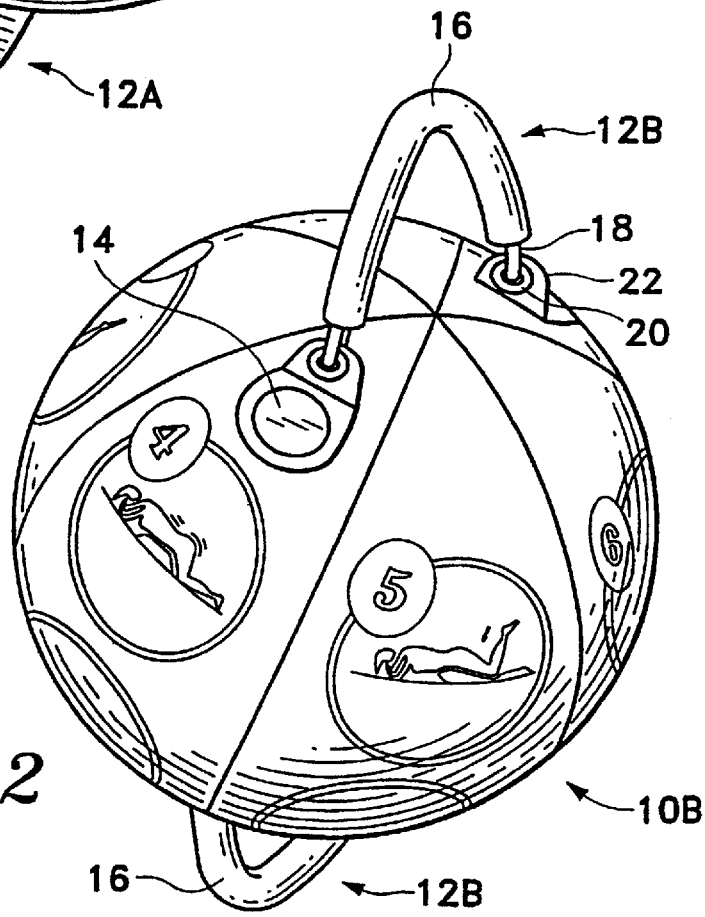
FIG. 2 is a perspective view of a second embodiment of an exercise ball of the present invention.

FIG. 2 is a perspective view of an exercise ball 10B, in a second embodiment of the present invention wherein each of the diametrically opposed pair of handles 12B consists of a hand grip 16 made from flexible tubing surrounding a flat loop of cord 18 extending as an eye at each end where the cord is threaded through a grommet 20 set in a tab 22. Each of the four tabs 22 is attached to the main portion of ball 10B by a sonic weld 14. The hand grips 16 may be round or oval in cross section.

In either embodiment the handle is made long enough that it forms an arched loop that can be placed over the foot and onto the leg of the person exercising.

The main ball portion 10A/B and the handles 12A/B are of flexible material, and may enclose a bladder portion; in a deluxe version of either embodiment, the outer surface of the main ball portion 10A/B may be covered with a fabric such as nylon or lycra.

Figure 3:
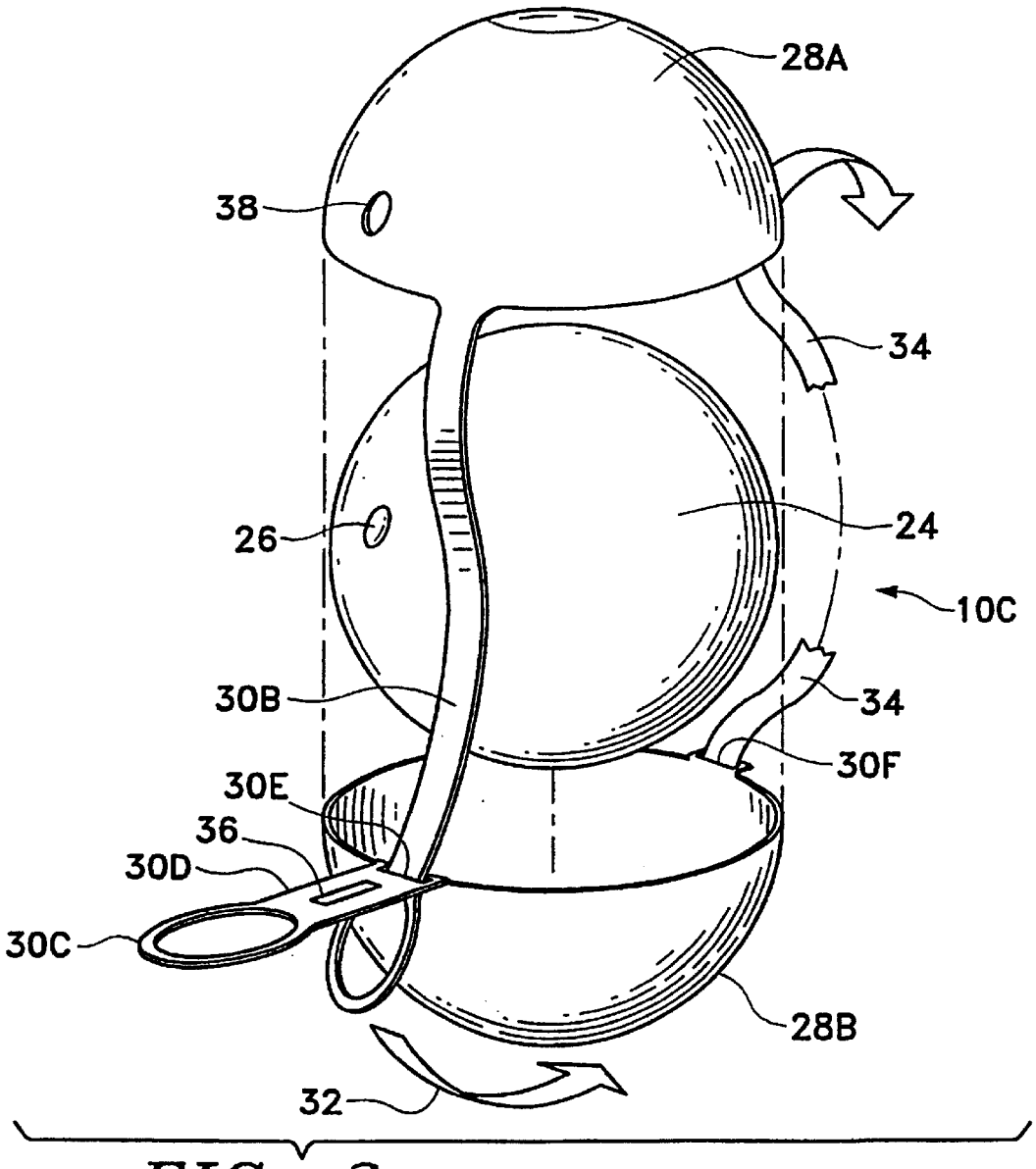
FIG. 3 is an exploded view of a third embodiment of an exercise ball of the present invention illustrating a pre-assembled condition.

FIG. 3 is an exploded perspective view of a third embodiment of an exercise ball 10C of the present invention illustrating a pre-assembled condition. The main bladder portion 24, preferably made from vinyl, may be fitted with a pressure sensor 26, which may include a pressure indicator such as a digital readout or analog display.

Shown above and below bladder 24, a fabric cover is made in two hemispheric portions 28A and 28B. The upper cover portion 28A is fitted with a handle 30A at the end of a long strap 30B. The lower cover portion 28B is fitted with a handle 30C at the end of a short strap 30D. The main lower cover portion 28B is fitted with a pair of similar handle pass-through slots, slot 30E located at the beginning of strap 30D, and slot 30F located at the edge of lower cover portion 28B diagonally opposite slot 30E. Handle 30A of the upper cover portion 28A is shown having been inserted through slot 30E as the first step in assembly. In subsequent assembly, handle 30A will be moved around cover portion 28B as indicated by arrow 32, passed through slot 30F as indicated by arrow 34, passed through a similar slot in upper cover portion 28A (not visible in this view) and directed outwardly, pulling the two cover portions 28A and 28B toward each other and securing them in place, fitting snugly over bladder 24. Additional fastening means, such as Velcro fastenings, may be used to fasten the cover portions 28A and 28B to the bladder 24 so as to effectively join them together around their peripheral region.

An opening 38 may be provided in the upper cover portion 28A at the location of pressure sensor 26 for visibility of a pressure indicator, when such is provided at that location.

Figure 4:
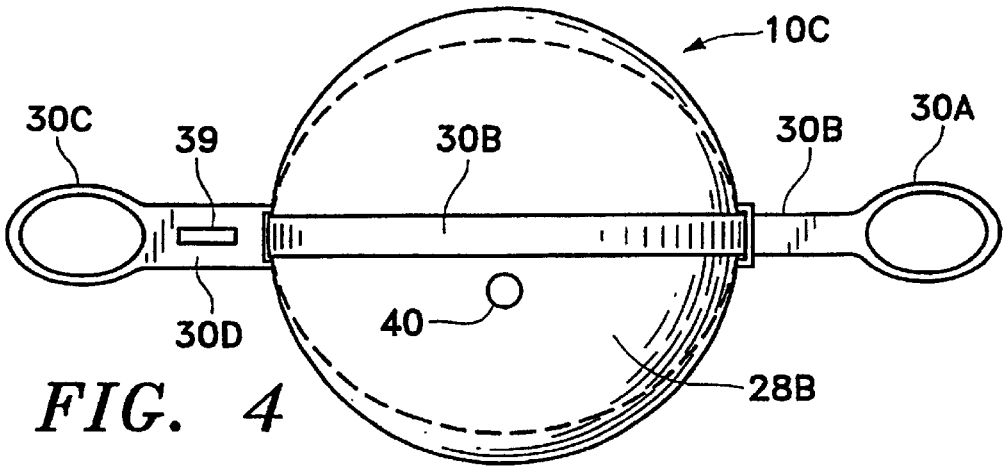
FIG. 4 is a bottom view of the exercise ball embodiment of FIG. 3 in an assembled condition.

FIG. 4 is a bottom view of the exercise ball 10C of FIG. 3 in an assembled condition. Strap 30B, seen laying against the surface of the lower cover portion 28B, is dimensioned in length to space handles 30A and 30C equal distances outwardly from the spherical main body of ball 10C thus simulating a pair of identical handles attached at diametrically opposite points in a like manner. This enables the ball 10C to act as a tension device for isometric exercise involving pulling outwardly on handles 30A and 30C in the same manner as described previously in connection with FIGS. 1 and 2. An opening 40 is shown for access to a bladder inflation valve; alternatively this could be located at any other location, as could sensor 26 and opening 38.

In the case where sensor 26 drives a separate pressure indicator, possible alternative locations for the indicator are shown in FIG. 3 at location 36 on the top side of strap 30D, and in FIG. 4 at location 39 on the bottom side of strap 30D. The pressure indicator can be of known art such as a mechanical gauge or an electronic digital or analog indicator implemented as and LED or LCD display panel.

Force applied to the exercise ball in either in tension via the handles, tending to distort the ball shown by dashed lines in FIG. 4, or in compression by squeezing the ball, increases the air pressure within the ball, thus the air pressure as sensed and indicated is generally proportional to the applied force.

As a further refinement, either as an addition to a pressure gauge or as an alternative thereto, the pressure sensor may be made to produce a visible or audible indication upon reaching a predetermined pressure level; the predetermined pressure level may be made variable with provision for adjustment by the individual using the ball, so that different muscular forces may be specified for various exercises and monitored accordingly. As a further alternative, a keypad may be provided separately or built in, for the purpose of enabling a user to enter muscular force and/or other data.

As optional variations to the structure shown in FIGS. 3 and 4, portions 28A and 28B could be made identical, at least with regard to the straps and handles:

(a) if both portions were made in the form of portion 28B, then each handle, being on a short strap 30D, would thread through the pass-through slot 30F of the opposite portion; there would be no need for the pass through slot 30E in the handle 30D; or (b) if both portions were made in the form of portion 28A with a long strap 30B on each handle and provided with a pass-through slot 30F at the opposite edge, then the straps would each pass through a slot 30E, make a half turn around opposite sides of the ball and then pass through slots 30F, extending therefrom to the respective handles.

For exercise use, the main ball portion 10A/B/C is inflated, via the valve in the manner of beach balls or basketballs, only to a somewhat underinflated condition about two-thirds to three-quarters of its fully distended capacity, so as to allow it to provide a firm accommodating even resistance to body regions of the person exercising.

There are two basic modes of using the ball for exercise:

(1) utilizing the ball as a tensile load by pulling apart on the handles, e.g. with hands or legs, so to effectively stretch the ball, and (2) utilizing the ball as a compressive load by squeezing it between user body regions or between a user body region and an immovable object such as a floor, bed or wall.

A special sequence of recommended exercises may be illustrated by graphics printed on the ball as indicated in FIGS. 1 and 2. An instruction booklet describing these exercises in detail may be provided in a marketing package with the exercise ball. Each exercise is directed to different areas of the body and utilizes the ball in an appropriate mode. Generally in each exercise, a steadily increasing muscular force is applied to the ball over a given time period, typically five seconds, then the force is released steadily over a similar time period.

When provided, the pressure readout, can be utilized in connection with tabulated data providing recommended muscular force in the various exercises according to individual characteristics such as age, weight, etc.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An exercise ball comprising:

a hollow inflatable bladder portion made from flexible material shaped to form a sphere of predetermined volume capacity when fully inflated;

a fabric cover constructed and arranged to surround the bladder portion so as to form a spherical entity;

at least two attachment straps, each attachment strap having a first end attached to the fabric cover;

one or more strap holders, each strap holder of said one or more strap holders configured to receive and hold a portion of at least one attachment strap of said at least two attachment straps; and a pair of looped handles disposed at diametrically opposed regions of the bladder portion, each looped handle of said pair of looped handles being attached to one attachment strap of said at least two attachment straps.

2. The exercise ball of claim 1, wherein said fabric cover comprises first and second complementary hemispheric fabric cover portions having peripheral regions, said hemispheric fabric cover portions being mutually attached around said peripheral regions.

3. The exercise ball of claim 2, wherein said at least two attachment straps comprise:

a first attachment strap, the first end of said first attachment strap being attached at a first attachment point at the peripheral region of the first fabric cover portion; and a second attachment strap, the first end of said second attachment strap being attached at a second attachment point at the peripheral region of the second fabric cover.

4. The exercise ball of claim 3, wherein said one or more strap holders comprise:

a first strap holder located near the first attachment point on the peripheral region of the first fabric cover portion, the first strap holder configured to receive and hold a first portion of the second attachment strap;

a second strap holder attached at the peripheral region of the first fabric cover portion diametrically opposite the first attachment point, the second strap holder configured to receive and hold a second portion of the second attachment strap; and a third strap holder attached at a peripheral region of the second fabric cover portion diametrically opposite the second attachment point, the third strap holder configured to receive and hold a third portion of the second attachment strap, wherein the second attachment strap is held by the first strap holder, the second strap holder, and the third strap holder to assist in holding the fabric cover portions together.

5. The exercise ball of claim 4, wherein said strap holders comprise pass-through slot means.

6. The exercise ball as defined in claim 1 further comprising a plurality of graphic illustrations printed on said fabric cover, each graphic illustration depicting said exercise ball being utilized in a different recommended isometric exercise.

7. The exercise ball as defined in claim 1 further comprising:

pressure sensing means constructed and arranged to sense air pressure within said exercise ball; and pressure indicating means, in operational connection with said pressure sensing means, constructed and arranged to visibly display an indication of air pressure within said exercise ball as sensed by said pressure sensing means.

8. The exercise ball as defined in claim 7 herein said pressure indicating means is located in a surface region of said bladder portion.

9. The exercise ball as defined in claim 7 wherein said pressure indicating means is located in an exposed region of one of the attachment straps.

10. The exercise ball as defined in claim 7 further comprising user-adjustable pressure-indicating means for providing a distinctive warning indication whenever air pressure in the ball rises to a predetermined pressure level that is selectable by a user.

* * * * *